US009155354B2

(12) United States Patent
Descamp

(10) Patent No.: US 9,155,354 B2
(45) Date of Patent: Oct. 13, 2015

(54) INSOLE TOPPER PAD FOR WEARING SHOES SOCKLESS

(75) Inventor: William Curtis Descamp, Woodway, TX (US)

(73) Assignee: William Curtis DesCamp, Pooler, GA (US)

( * ) Notice: Subject to any disclaimer, the term of this patent is extended or adjusted under 35 U.S.C. 154(b) by 618 days.

(21) Appl. No.: 13/507,391

(22) Filed: Jun. 25, 2012

(65) Prior Publication Data

US 2013/0340282 A1 Dec. 26, 2013

(51) Int. Cl.
*A43B 13/38* (2006.01)
*A43B 17/00* (2006.01)
*A43B 17/10* (2006.01)

(52) U.S. Cl.
CPC ..... *A43B 17/00* (2013.01); *A43B 17/006* (2013.01); *A43B 17/102* (2013.01)

(58) Field of Classification Search
CPC .... A43B 17/00; A43B 17/102; A43B 17/006; A43B 17/10; A43B 17/14; A43B 23/25
See application file for complete search history.

(56) References Cited

U.S. PATENT DOCUMENTS

| | | | | | |
|---|---|---|---|---|---|
| 1,120,113 | A | * | 12/1914 | Zsemba | 36/44 |
| 1,412,603 | A | * | 4/1922 | Berry | 36/44 |
| 1,588,011 | A | | 6/1926 | Campbell | |
| 2,427,986 | A | * | 9/1947 | Whitman | 36/173 |
| 2,495,045 | A | * | 1/1950 | Woodbury et al. | 36/44 |
| 2,622,348 | A | * | 12/1952 | Sellinger | 36/44 |
| 2,641,068 | A | * | 6/1953 | Thompson | 36/44 |
| 2,736,109 | A | * | 2/1956 | Scholl | 36/44 |
| 4,062,131 | A | * | 12/1977 | Hsiung | 36/44 |
| 4,185,402 | A | | 1/1980 | Digate | |
| 4,192,019 | A | | 3/1980 | Lingenfelter | |
| 4,387,516 | A | | 6/1983 | Laux | |
| 4,729,179 | A | * | 3/1988 | Quist, Jr. | 36/44 |
| 5,392,533 | A | | 2/1995 | Gerhartl | |
| 5,452,525 | A | * | 9/1995 | Miyauchi | 36/44 |
| 7,373,740 | B2 | * | 5/2008 | Lo | 36/44 |
| 2008/0184593 | A1 | | 8/2008 | Draghiceanu | |
| 2009/0211112 | A1 | * | 8/2009 | Polegato Moretti | 36/44 |
| 2009/0282705 | A1 | * | 11/2009 | Trigillo | 36/3 B |

* cited by examiner

*Primary Examiner* — Jila M Mohandesi

(57) ABSTRACT

The present invention is an insole topper pad adapted to provide an absorbent perspiration barrier between the bottom surface of the bare human foot and the top surface of a shoe's insole or footbed. The insole topper pad enables a user to easily transition from going barefoot to wearing shoes in a sockless manner, while further retaining a relatively hygienic environment within the shoe. The insole topper pad may be easily inserted in, or removed from, articles of footwear, and conveniently laundered on a daily basis. Further, the worry of unhealthy and embarrassing odors produced from prolonged bacteria build-up within a shoe may be substantially reduced. While eliminating the need for traditional socks, the insole topper pad allows the user to comfortably and sanitarily adapt to fashion and lifestyle trends which have significantly shifted, exposing the bare lower leg and ankle portion of the foot while wearing low rise shoes.

13 Claims, 9 Drawing Sheets

INSOLE TOPPER PAD FOR WEARING SHOES SOCKLESS

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to footwear apparatus; and more particularly to a novel and improved machine washable insole topper pad used for absorbing and retaining perspiration, exfoliated dead skin cells, and other soils which may accumulate therein-between the sole of a human foot and the insole or footbed of an article of footwear when wearing such footwear barefooted and without socks, stockings or hosiery.

DISCUSSION OF RELATED ART

Insoles provide a greater amount of cushioning and support to the human foot and are usually permanently or removably attached to the footbed of an article of footwear, furthermore referred to herein as shoes. Traditional insoles are typically comprised of bonded layers of material such as foams, gels, plastics, fabrics or leathers which are molded and trimmed to conform to the inner lining of a shoe's footbed, and respectively, to the sole of a human's foot.

As a user wears the shoes barefooted and without socks, temperatures generally rise therein, causing sweat glands to secrete perspiration, particularly between the sole of the user's foot and the insole or footbed of the shoe. This may further be compounded on warmer days, depending upon the level of breathable attributes formed within the shoe or insole of the shoe. As such residual perspiration accumulates, harmful bacteria forms, creating a warm, sticky and odor-filled environment that generally becomes increasingly intensified each day the shoes are worn. Exfoliated dead skin cells and other soils may additionally collect therein, further accentuating the problem and compromising comfort to the user.

Although some insoles may be removed and washed by hand, the process for many is time consuming, impractical and cumbersome if attempted on a daily basis. Moreover, as the majority of such modern insoles are manufactured, all or in part of said synthetic materials, most sustain buoyancy when washed, particularly in top-loading machines. Because of these characteristics, sufficient agitation amongst other clothing is prevented, thereby resulting in an inadequate cleansing of the article. Further, when such insoles are dried in a modern day clothes dryer, the intense heat many times tends to distort the insole's form, often to a degree that prevents re-use.

To help alleviate this problem, while adding additional comfort and warmth to the foot, socks, stockings and hosiery have been utilized for centuries. In recent times however, particularly in the warmer months, fashion and lifestyle trends have substantially shifted from shoes being worn with socks of minimal coverage, fitted to, or just above the ankle, to shoes again being worn completely sockless. Despite the described negative attributes associated with such bacteria formed therein, many footwear manufactures today have quickly realized this substantial market trend and have respectively responded with an abundance of minimalist style shoes, specifically designed to be worn in direct contact to the user's foot. However, such minimalist, flats and particularly sneaker, athletic, and loafer style shoes still remain widely subject to such bacteria issues when worn sockless.

To further address the problem, deodorizing insoles and other odor reduction type products have been made widely available on the market today. Unfortunately most, if not all are adapted specifically for reducing or masking the odor rather than adapting to a more absorbent type article that can be easily laundered on a daily basis such as are other ordinary undergarments. Moreover, the bulk of deodorizing or other type insoles currently offered are configured as a do-it-yourself, universal sizing concept requiring the insoles or inserts to be cut-to-fit by the user such as disclosed in U.S. Pat. No. 4,387,516 issued to Laux on Jun. 14, 1983. Although the universal configurations are practical for reducing manufacturing costs, the task presented to the consumer is time consuming and inconvenient, particularly in disposable applications where the user may go through many inserts in a year's time. Furthermore, shears, knifes or blades are required to trim such inserts to fit, exposing the user to unnecessary laceration type hazards.

U.S. Patent Application Publication No. US 2008/0184593 A1 for Draghiceanu published Aug. 7, 2008 discloses an insole covering that is adapted to act as a sleeve for a shoe insole providing a barrier between the sole of a user's foot and the insole or insert of a shoe. The shoe insole covering is useful for those individuals who prefer not to wear socks, however, the task of removing an insole, slipping the covering over it, and then replacing the insole into the shoe may become a time consuming, impractical and cumbersome task when applied to use on an everyday basis. Further, many insoles to be found within shoes are permanently adhered to the footbed of the shoe during the manufacturing process, rendering the invention useless without destroying the mechanical integrity of the shoe. Moreover, fabrics utilized in stretching type applications typically tend to be less absorbent due to the synthetic makeup, therefore reducing moisture absorbing properties.

One prior art taught in U.S. Pat. No. 1,588,011 issued to Campbell on Jun. 8, 1926 provides a washable insole for shoes. The insole is adapted to be washable; however, it must have stiffeners removed prior to being cleaned, again proving to be a cumbersome and inconvenient method to the user. Further, the insole is partially constructed of woven straw materials that may be inferior in comfort level in contrast to materials offered in today's marketplace.

Another prior art taught in U.S. Pat. No. 4,192,019 issued to Lingenfelter on Mar. 11, 1980 discloses a mini sock. The mini sock is formed to rest just below the ankle with a portion overlapping the shoe. The mini sock further incorporates a bulbous mass attached to the upper heel portion of the sock providing decoration and a method of retaining the sock from slipping down the heel portion of the shoe while walking or exercising. The mini sock provides a practical method of moisture absorption without covering the ankle and calf portion of the leg with cloth and further may be effectively machine washed and dried by modern day appliances. However, the mini sock does not address the user that desires a smooth and expedited transition from being barefoot to wearing shoes. Moreover, the mini sock alters the shoes appearance by folding over the rear portion of the shoe which may prove to be less desirable in style by many.

Yet another prior art taught in U.S. Pat. No. 5,392,533 issued to Gerhartl on Feb. 28, 1995 discloses a disposable shoe insole and method for making the same. The insole provides a method to absorb moisture and accomplishes the ability to readily slip a barefoot into and out of a shoe. However, because it is designed to be disposable after use, the article may become costly to exchange on a daily basis, and further, un-necessary landfill is created.

Still further, a prior art taught in U.S. Pat. No. 4,185,402 issued to Digate on Jan. 29, 1980 discloses a deodorizing insole. The insole is constructed of a multi-layer configuration that utilizes charcoal as an active deodorizing ingredient embedded within said layers. Although the insole acts as a deodorizer, its properties prevent the insole from being practically machine washed and dried. Moreover, because it is constructed partially of open cell latex foam, the insole inherently may lose its effectiveness to absorb the amount of moisture that the human foot produces in an average day and further may become problematic to those allergic to said latex type materials.

Therefore, a need exists for a shoe insert, furthermore referred to herein as an insole topper pad, that may be easily placed therein-between a user's foot and an insole or footbed of a shoe, providing the user a comfortable and convenient method and means of absorbing perspiration secreted from the foot's sweat glands. Additionally, such an insert would accommodate the sockless look as desired by many while providing an adequate moisture absorbing barrier therein-between the bare sole of the human foot and the insole or footbed of a shoe. Such an insert would be easily insertable into a shoe, easily removable from a shoe, resist buckling while in the shoe, and be conveniently machine washable on a daily basis in a typical household or commercial setting. Such an insert may furthermore comprise materials, that when assembled, would overall relinquish buoyant attributes in order that the insert may thoroughly be mixed therein a load of laundry and properly agitated without rising to the surface, as might plastic or rubber based products. Such an insert would as well be configured to resist shrinkage during the laundering process, thereby retaining a proper end-to-end fit within the shoe, preventing slippage therein. Furthermore, such an insert would be individually tailored to fit therein a shoe according to shoe size, thus eliminating a need to trim-to-fit by the user, increasing safety. Still further, such an insert would be self-moldable to both the sole of a human foot as well as the insole or footbed of a shoe, providing additional comfort to the user. Moreover, such an insert would include a soft, absorbent fabric layer that may come into contact with not only the pad surfaces of the human foot, but the arched surfaces of the human foot as well, accommodating maximum comfort and absorption of perspiration thereto. Similarly, such an insert would be adapted to cleanse the sole of a human foot, attracting thereto soil, dead skin and debris that may be accumulated therein a shoe as it is worn by the user, particularly in a dusty or more soiled environment. Finally, such an insert may be reversible in configuration, allowing the user to avoid having to distinguish between a right hand insert from a left hand insert, thereby promoting much easier insertion and removal of said insert into and out of an article of footwear.

The insole topper pad substantially departs from conventional concepts and designs of prior art. It can be appreciated that there exists a continuing need for an easily washable shoe insole topper pad which may be used on an everyday basis by millions as traditional socks, stockings or hosiery have been used for centuries. By departing from the aforementioned methods, the present invention accomplishes all the noted objectives.

SUMMARY OF THE INVENTION

It is therefore an object of the present invention to provide for a novel and improved method and means for enabling a user to comfortably wear shoes sockless in a more practical and sanitary manner.

It is another object of the present invention to provide for a novel and improved method and means of absorbing and retaining perspiration, exfoliated dead skin cells and other soils which may accumulate therein-between the sole of a human foot and the insole or footbed of an article of footwear when wearing such footwear barefooted and without socks.

It is moreover an object of the present invention to provide a novel and improved shoe insert adapted to be effectively laundered on a daily basis, which moreover resists shrinkage to maintain an accurate end-to-end fit within an article of footwear.

It is further an object of the present invention to provide for a novel and improved method and means for effortless insertion of an insert into a shoe and effortless removal of an insert from a shoe.

It is likewise an object of the present invention to provide a novel and improved shoe insert adapted to self mold to the contour of both the sole of the human foot and respectively to the insole or footbed of an article of footwear.

In accordance with the present invention, a method and apparatus for wearing shoes barefooted without conventional style socks has been devised which is broadly comprised of at least one layer of absorbent fabric, at least one extended ribbon pull loop, and at least one layer of one layer of synthetic felt material that may be stacked along a longitudinal axis and permanently attached thereto by means of at least one adhesive film layer in conjunction with a thread-bound peripheral edge or the like.

The synthetic felt core layer includes a top surface and a bottom surface in which at least one surface may be coated thereto with said adhesive film. The synthetic felt core layer may include a peripheral edge pattern that mirrors that of the sole of a human foot or the basic shape of a typical shoe insole. The peripheral pattern may further include a protruded portion on one side that may adequately cover the arched portion of the footbed or insole when inserted into a shoe, providing added comfort to the user.

The absorbent fabric layer placed on the at least one surface of the synthetic felt core material includes a top surface and a bottom surface and may be comprised of a woven terry cotton material such as what one would find in a high quality bath towel or the like. Further, the absorbent woven cotton fabric layer may be comprised of a cotton flannel fabric or the like. Likewise, the absorbent woven cotton fabric layer may be replaced by, or used in conjunction with a layer of absorbent non-woven viscose, commonly referred to as Rayon. The peripheral pattern of the absorbent fabric layer may identically match that of the felt core. The peripheral binding may be accomplished by the method of thread stitching alone, or wrapped therewith a ribbon of fabric and stitched thereto by thread or similar method.

A loop comprised of a ribbon type material may further be incorporated, extending beyond the aforesaid peripheral edge to aid in the removal of the insert from the shoe.

The synthetic felt core layer may be comprised of polyester felt or the like that remains relatively firm when washed by a typical household or commercial type washing machine, yet retains shape without substantial shrinkage when dried by a conventional household or commercial type clothes dryer.

The combined natural and synthetic materials may be configured in such a manner that said materials maintain a non-buoyant attitude when submerged during the mechanical washing process, thus providing a more agitated and thorough cleaning of the device.

In use, the insole topper pad may easily be inserted into articles of footwear such as, but not limited to, sneakers, athletic shoes, flats or loafers. By incorporating a layer of absorbent fabric on both the top surface and the bottom surface of the pad, the insert may be readily reversible allowing convenient insertion in either the right shoe or left shoe, regardless of top-to-bottom orientation. The insole topper pad may further be placed either on top of, or in place of a shoe's insole, moreover increasing adaptability.

Upon placing a barefoot within a shoe containing an insole topper pad, the user will immediately experience a refreshing, soft and "like-new" feel upon the sole of their foot. An individual that enjoys being barefoot the majority of time will readily appreciate the ability to quickly slip on, or slip off a pair of conventional enclosed shoes when the need arises, without such time consuming efforts associated with having to put socks on, or respectively take socks off. Moreover, the user may enjoy running, jogging, exercising or walking while wearing shoes sockless, without the feeling of wetness, or worry of annoying and embarrassing odors created from prolonged secreted perspiration absorbed and retained by the shoe or shoe's insole placed therein.

The insole topper pad may quickly and effortlessly be removed by placing fingers under and over the edge of the insert and gently pulling upward and outward; or by simply pulling on an extended loop of ribbon attached thereto the peripheral edge of the insert. The insole topper pad may then be easily laundered on a daily basis by means of a common household top or front loading washing machine and dried by a common household dryer without the worry of shrinkage or other common problems associated with laundering of shoe insoles and inserts. Once inserted, the insole topper pad may be adapted to lie on top of the insole or footbed within a shoe, positioned end-to-end, thereby eliminating slippage and buckling. The insole topper pad may further be configured to easily mold to the bottom of the user's foot in addition to the top of the shoes insole or footbed therein, providing additional comfort and support to the user. Finally, the insole topper pad may be adapted to absorb and retain exfoliated dead skin cells and other soils or particles which may accumulate therein-between the sole of a human foot and the insole or footbed of an article of footwear. The present invention enables a user the ability to wear shoes sockless in a more practical and sanitary manner.

The above and other objects, features and advantages of the present invention will become apparent, understood, and be more readily appreciated from the following more detailed description of the preferred embodiment thereof, when taken in conjunction with the accompanying drawings, which illustrate by way of example the principles of the invention.

DESCRIPTION OF THE DRAWINGS

In the accompanying drawings.

DETAILED DESCRIPTION OF THE PREFERRED EMBODIMENT

Figure 1:
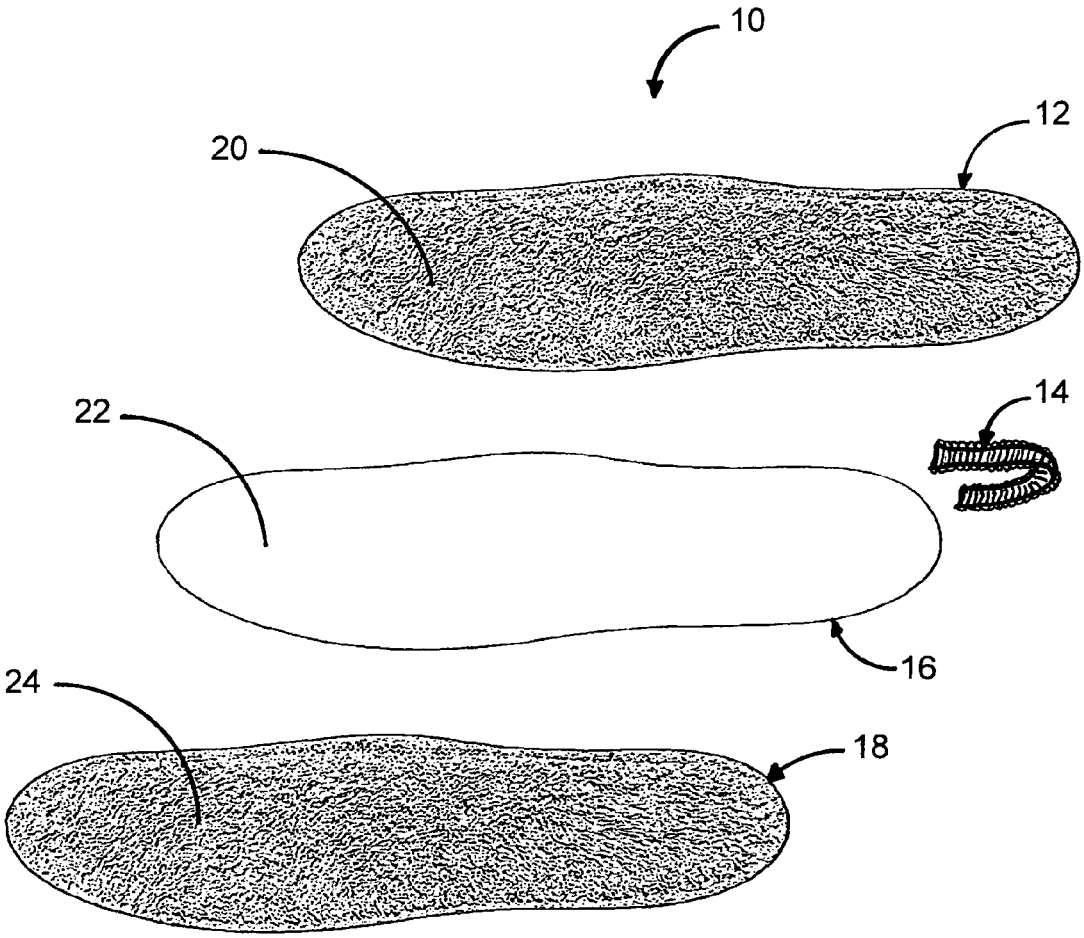
FIG. 1 is an exploded perspective view of the present invention illustrating a top surface of the at least one top layer of absorbent fabric layer, the top surface and the bottom surface of the at least one extended ribbon pull loop, a top surface of the at least one synthetic felt core layer, and a top surface of the at least one bottom layer of absorbent fabric.

FIG. 1 is an exploded perspective view of the present invention 10, illustrating an insole topper pad 10. The insole topper pad 10 is an apparatus for wearing shoes (not shown) barefooted and without conventional style socks, stockings or hosiery (not shown), which is broadly comprised of at least one layer of absorbent fabric 12, 18, at least one extended ribbon pull loop 14, and at least one layer of synthetic felt stiffening material 16, that is stacked along a longitudinal axis and may be permanently attached thereto by at least one layer of adhesive film (not shown), utilized in conjunction with a surged peripheral edge (not shown) or further bound by ribbon edging (not shown) which may be stitched thereto with natural or synthetic threading (not shown).

The at least one said absorbent fabric layer 12, 18 placed on said top surface 22 of the at least one said synthetic felt core layer 16 or on the bottom surface (not shown) of the at least one said synthetic felt core layer 16 includes a top surface 20, 24 and a bottom surface (not shown). The at least one said absorbent fabric layer 12, 18 may further be comprised of an absorbent woven cotton terry fabric (not shown), woven cotton flannel fabric (not shown) or the like. Likewise, the absorbent fabric layer 12, 18 may be replaced by, or used in conjunction with a layer of absorbent non-woven viscose 12, 18, commonly referred to as Rayon. The peripheral shape of said absorbent fabric layer 12, 18 may moreover identically match that of said synthetic felt core layer 16.

The at least one said synthetic felt core layer 16 includes a top surface 22 and a bottom surface (not shown) in which at least one surface may be coated with said adhesive film (not shown). The peripheral shape of said synthetic felt core layer 16 may moreover identically match that of the at least one said absorbent fabric layer 12, 18. Further, the said synthetic felt core layer 16 may be comprised of polyester felt (not shown)

or other like synthetic felt materials (not shown) that may remain reasonably firm when washed by a typical household or commercial washing machine (not shown) and furthermore may retain shape without substantial shrinkage when dried by a conventional household or commercial type clothes dryer (not shown).

The at least one said extended ribbon pull loop 14 being attached by thread stitching (not shown) therein-between the at least one said absorbent fabric layer 12, 18 and the at least one said synthetic felt core layer 16 may be comprised of standard type fabric ribbon material (not shown) and may be configured in various colors (not shown).

Figure 2:
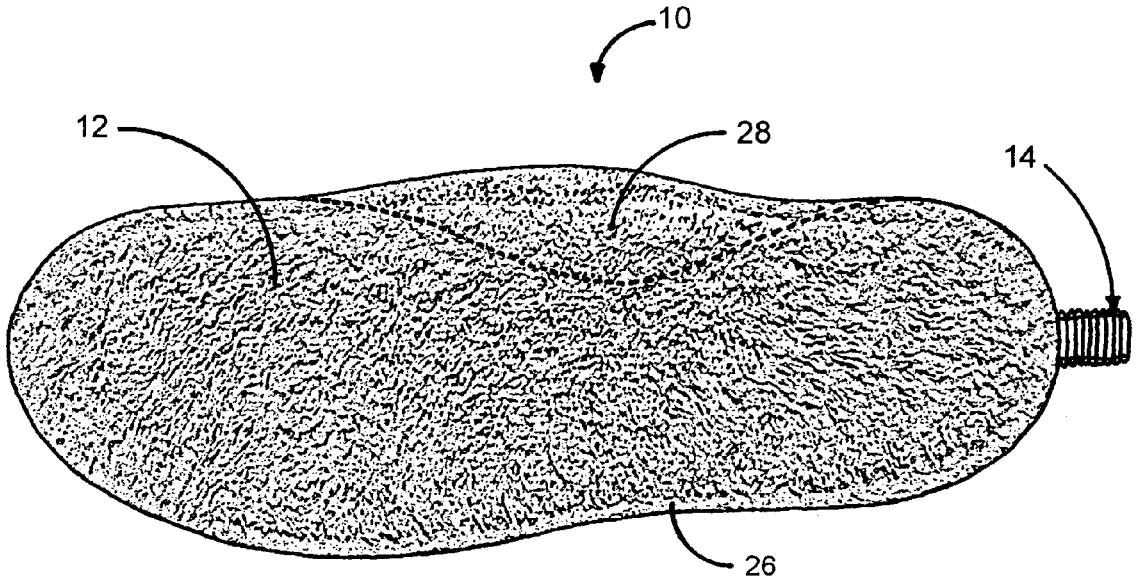
FIG. 2 is a top view of the present invention, illustrating an insole topper pad highlighting a protruding portion, represented in an un-used condition.

FIG. 2 is a top view of the present invention 10, illustrating an insole topper pad 10, represented in an un-used condition, for wearing footwear sockless. The insole topper pad 10 may include an extended protruding portion 28 (FIG. 2, FIG. 5, FIG. 6) adapted to provide further comfort and moisture absorption capabilities to the arched portion of the human foot. The extended protruding portion 28 may adequately cover the arched portion of the footbed (not shown) or insole of the shoe (not shown). Moreover, the insole topper pad 10 may include a peripheral shape that may mirror that of the sole of a human foot (not shown) or that of a typical shoe insole (not shown).

Figure 3:
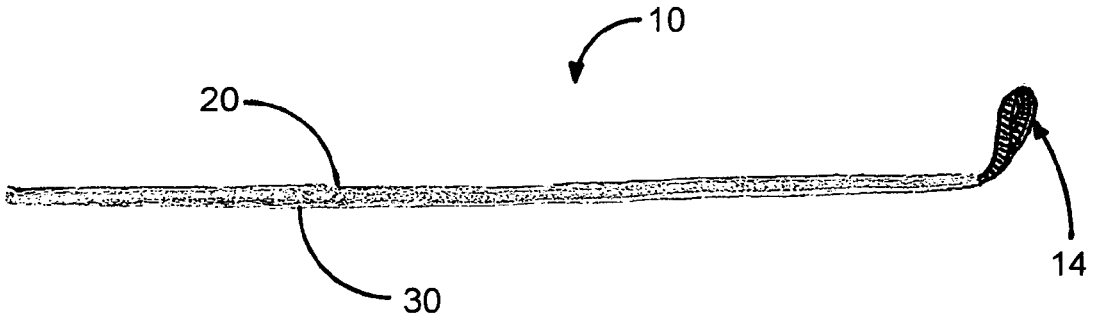
FIG. 3 is a side view of the present invention, illustrating a top layer of at least one absorbent fabric, a bottom layer of at least one absorbent fabric, and at least one extended ribbon pull loop bound thereto by surged edging, represented in an un-used condition.

FIG. 3 is a side view of the present invention 10, illustrating the insole topper pad 10. The insole topper pad 10 may include a pre-use thickness (excluding the peripheral edge) ranging between 2 mm to 12 mm and further may include a compressed in-use thickness (excluding the peripheral edge) ranging between 1 mm to 4 mm. The at least one said extended ribbon loop 14, comprised of ribbon type material (not shown), may further be incorporated to aid in convenient removal of the insert from the shoe (not shown).

Figure 4:
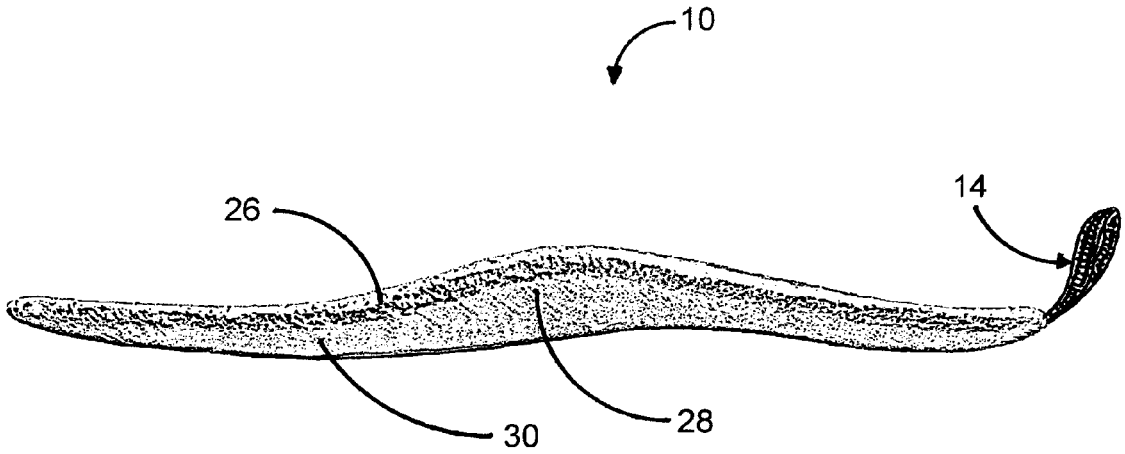
FIG. 4 is a side view of the present invention illustrating a bottom surface of at the least one absorbent fabric layer, a bottom surface and a top surface of the at least one extended ribbon pull loop and side peripheral edge surfaces as formed during use by applied pressure from the human foot.
Figure 5:
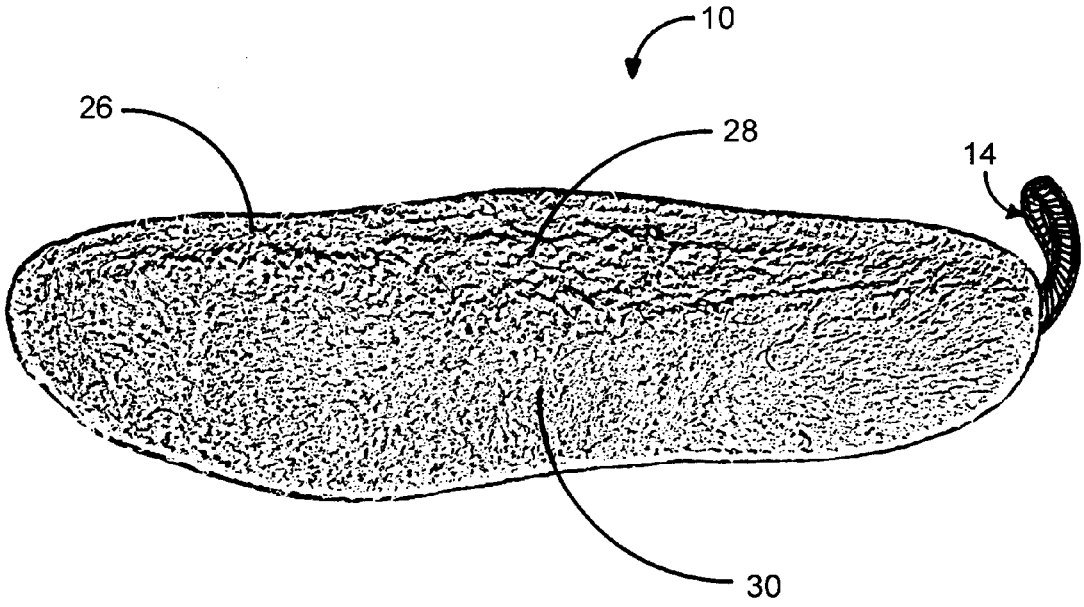
FIG. 5 is a perspective view of the present invention illustrating a bottom surface of the at least one absorbent fabric layer, a bottom surface and a top surface of the at least one extended ribbon pull loop, and side peripheral edge surfaces as formed during use by applied pressure from the human foot.
Figure 6:
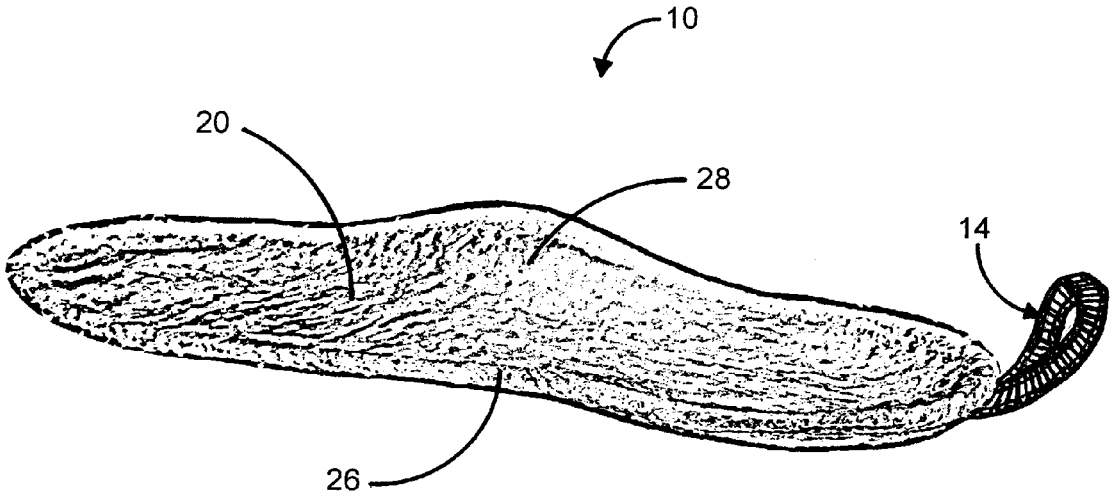
FIG. 6 is a perspective view of the present invention illustrating a top surface of at the least one absorbent fabric layer, a bottom surface and a top surface of the at least one extended ribbon pull loop, and side peripheral edge surfaces as formed during use by applied pressure from the human foot.

FIG. 4 thru FIG. 6 discloses a side view, a lower perspective view and an upper perspective view of the present invention 10, illustrating an insole topper pad 10 as formed during use by pressure of the human foot (not shown). By incorporating at least one said synthetic felt core layer (not shown), the insole topper pad 10 may be configured to retain sufficient stiffness as to remain easily insertable into an article of footwear (not shown) and yet supple enough to easily conform to the contours of the sole of a human foot (FIG. 4 and FIG. 6) and respectively to the insole or footbed contours of a shoe (FIG. 5).

Figure 7:
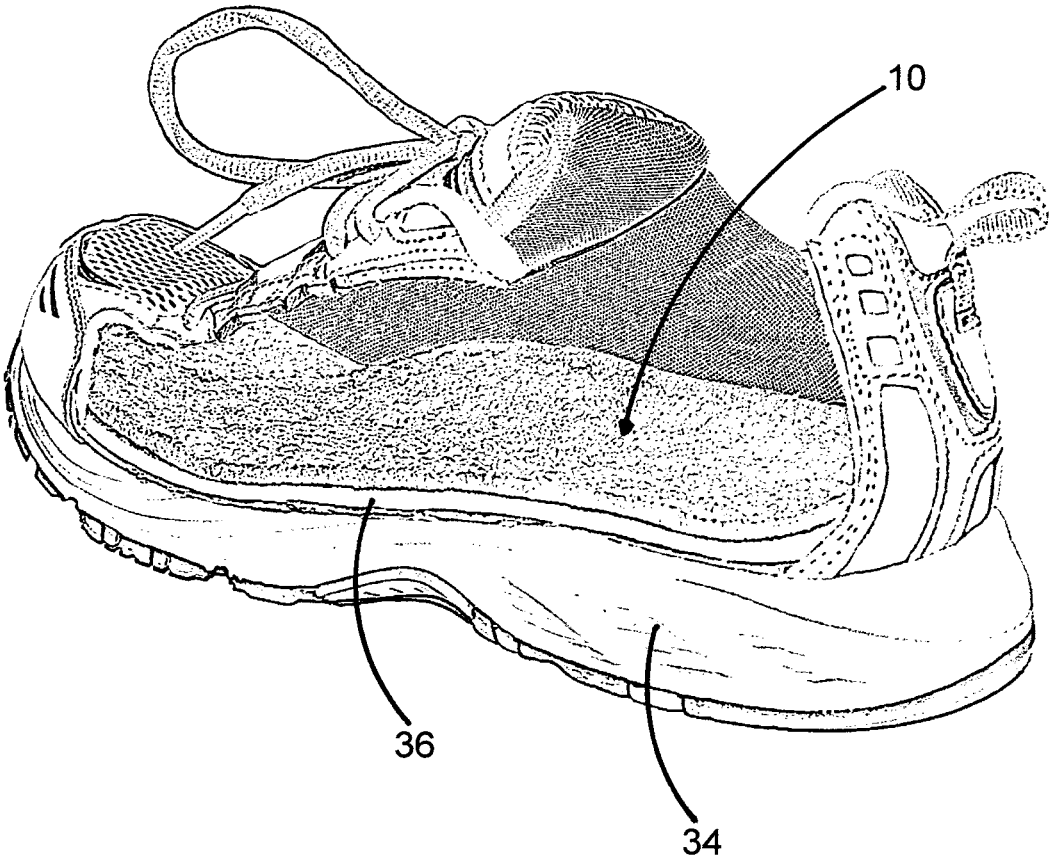
FIG. 7 is a partial cutaway view of a typical athletic shoe illustrating positioning of the present invention within the shoe.

FIG. 7 is a partial cutaway view of a typical athletic style shoe 34, illustrating positioning of the present invention 10 within said shoe 34. Once placed into said shoe 34, the insole topper pad 10 may be adapted to lie on top of the insole 36 or footbed (not shown) of said shoe 34, positioned end-to-end, thereby eliminating slippage and buckling while inserting the foot (not shown) into said shoe 34.

Figure 8:
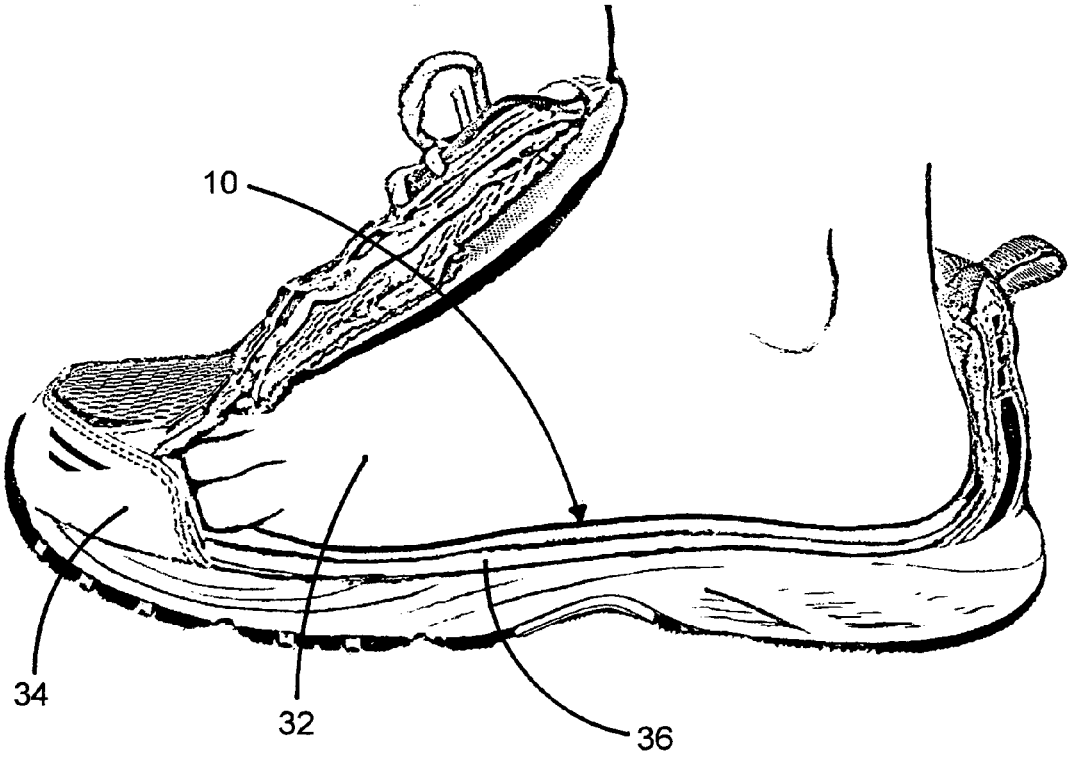
FIG. 8 is a partial cutaway view of a typical athletic shoe illustrating the present invention as positioned within the shoe during use, sandwiched therein-between the sole of a human foot and the insole of the shoe.

FIG. 8 is a partial cutaway view illustrating the present invention 10 as placed therein a typical athletic style shoe 34, sandwiched therein-between said insole 36 of said shoe 34 and a bare human foot 32. Further, the insole topper pad 10 may be adapted to easily mold to the bottom contours of the user's foot (not shown) as well as the top contoured surface of said shoes insole 36 or footbed (not shown), providing the user further comfort and support.

Figure 9:
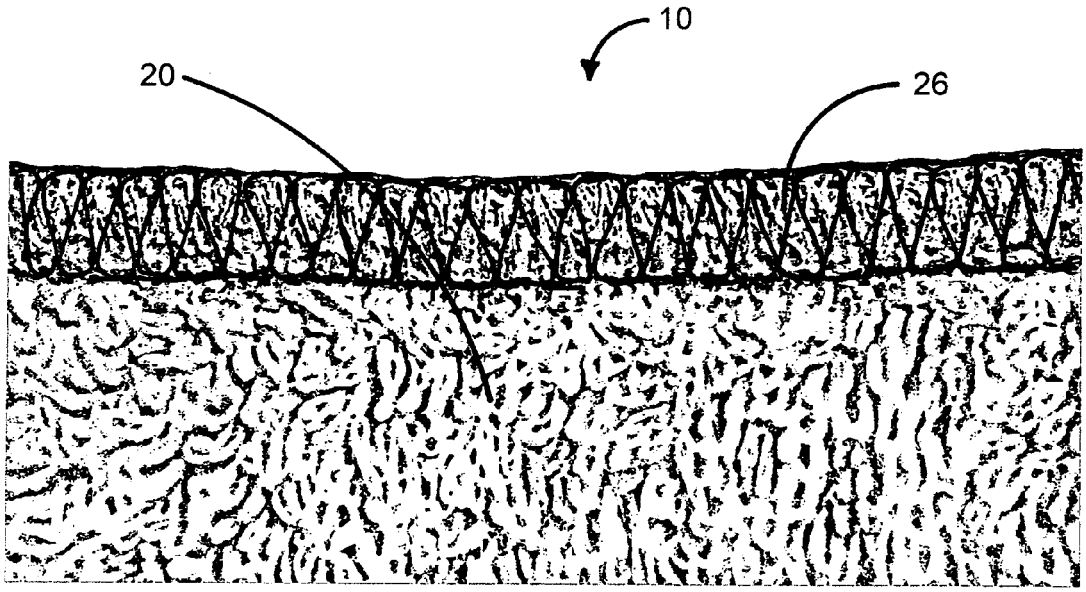
FIG. 9 is a top view of the present invention illustrating a detailed portion of the at least one bound edge.

FIG. 9 is a detailed top view of the present invention 10, illustrating a bound edge 26. The peripheral binding 26 may be accomplished by the method of surging 26 alone, or wrapped therewith a ribbon of fabric (not shown), furthermore stitched by natural or synthetic thread (not shown), or similar like method.

In use, referring to FIG. 1 thru FIG. 9, the insole topper pad 10 enables a user (not shown) the ability to wear shoes 34 sockless in a more practical and sanitary manner. The insole topper pad 10 may easily be inserted into articles of footwear such as, but not limited to, athletic shoes 34, sneakers (not shown), flats (not shown) or loafers (not shown). The insole topper pad 10 may further be utilized with or without traditional type socks (not shown) in other sportswear applications such as, but not limited to, ski boots (not shown), snowboarding boots (not shown), or hiking boots (not shown). By incorporating an absorbent layer of said woven cotton or non-woven viscose fabric 12, 18 on both the top surface 22 and the bottom surface (not shown) of said synthetic felt core layer 16, the insole topper pad 10 may be readily reversible allowing convenient insertion in either the right shoe (not shown), or left shoe (not shown), regardless of top-to-bottom orientation. The insole topper pad 10 may further be placed either on top of, or in place of a shoe's insole 36, moreover increasing adaptability.

Upon placing a bare foot 32 within a shoe 34 containing an insole topper pad 10, the user (not shown) may immediately experience a refreshing, soft, and "like-new" feel upon the sole of their foot (not shown). An individual (not shown) that enjoys being barefoot the majority of time will readily appreciate the ability to quickly slip on or slip off a pair of shoes 34 when the need arises, without the time consuming efforts associated with having to put socks (not shown) on, or respectively, take socks off. Moreover, the user (not shown) may enjoy running, jogging, exercising or walking while wearing shoes 34 sockless, without the feeling of wetness or worry of annoying and embarrassing odors created from prolonged perspiration (not shown) absorbed and retained therein by said shoe 34.

On a daily basis, the insole topper pad 10 may quickly and effortlessly be removed from an article of footwear 34 by placing fingers (not shown) under and over said peripheral edge 26 of the insole topper pad 10 or by simply pulling on an extended loop of said ribbon 14 which may be permanently attached to said peripheral edge 26 of the insole topper pad 10. The insole topper pad 10 may then be easily laundered (not shown) by means of a common household or commercial top or front loading washing machine (not shown) and dried by a common household or commercial clothes dryer (not shown) without the worry of shrinkage (not shown) or other common problems associated with the laundering of shoe insoles and inserts (not shown). Further, the combined natural and synthetic materials (not shown) may be configured whereas the insole topper pad 10 will remain non-buoyant or partially submerged during the mechanical washing process (not shown), thus providing thereto a more agitated and thorough cleaning.

Once inserted therein an article of footwear 34, the insole topper pad 10 may be adapted to lie within said shoe 34, positioned end-to-end, thereby eliminating slippage and buckling (not shown). The insole topper pad 10 may further be configured to easily mold to the sole (not shown) of the user's foot 32 in addition to the top surface (not shown) of the shoe's insole 36 or footbed (not shown), providing further comfort and support to the user (not shown). Moreover, the insole topper pad 10 may be adapted to cleanse the sole of a human foot 32, attracting thereto soil (not shown), dead skin (not shown) and small debris (not shown) that may be accumulated therein a shoe 34 as it is worn by the user (not shown), particularly in dusty or more soiled environments. Respectively, the insole topper pad 10 may provide the same cleansing action (not shown) on the insole 36 or footbed side (not shown) of the insole topper pad 10.

While a particular form of the invention 10 has been illustrated and described, it will be apparent that various modifications may be made without departing from the spirit and scope of the invention 10. Accordingly, it is not intended that the invention 10 be limited, except as by the appended claims.

What is claimed is:

1. An insole topper pad adapted to absorb perspiration secreted from the bottom surfaces of a foot, when placed therein an article of footwear, said insole topper pad comprising:

an absorbent fabric top layer having a top surface, a bottom surface, and a peripheral edge thereof;

an extended ribbon pull loop, having a top surface, a bottom surface, and a peripheral edge thereof;

a middle synthetic felt core layer, having a top surface, a bottom surface, and a peripheral edge thereof; and an absorbent fabric bottom layer having a top surface, a bottom surface, and a peripheral edge thereof;

wherein said absorbent fabric top layer, said extended ribbon pull loop, said synthetic felt core layer and said absorbent fabric bottom layer are stacked along a longitudinal axis and permanently secured together by adhesive film layers in conjunction with stitching that bound the peripheral edges together;

wherein said insole topper pad further comprises a protruded portion on a longitudinal edge of the insole topper pad which adequately covers an arched portion of an insole and which is adapted to provide a user a more sanitary an easy way to wear articles of footwear barefooted while retaining the ability to absorb perspiration without the use of common calf-high socks, ankle-high socks, no-show socks, footies, stockings or hosiery; wherein said insole topper pad is moldable from a flattened configuration to a contoured configuration during use.

2. The insole topper pad according to claim 1, wherein said absorbent fabric layers are comprised of non-woven viscose fiber.

3. The insole topper pad according to claim 1, wherein the synthetic felt core layer provides stiffness to the insole topper pad; and wherein said synthetic felt core layer has a breathable structure which transfers moisture from said top absorbent fabric layer to said bottom absorbent fabric layer.

4. The insole topper pad according to claim 1, wherein said insole topper pad is adapted to absorb perspiration from the inboard bottom arched portion of a foot as well as the bottom main load-bearing surfaces of a foot.

5. The insole topper pad according to claim 1, wherein the protruded portion of the insole topper pad provides additional stiffening structure to the entire longitudinal surface of said insole topper pad; and wherein said protruded portion further provides a grasping surface for quickly inserting and quickly removing said insole topper pad from an article of footwear.

6. The insole topper pad according to claim 1, wherein the combined total pre-use thickness of said top absorbent fabric layer, said layers of adhesive film, said synthetic felt core layer, said extended ribbon pull loop and said bottom absorbent fabric layer ranges between 2 mm to 12 mm.

7. The insole topper pad according to claim 1, wherein the combined total post-use molded thickness of said top absorbent fabric layer, said layers of adhesive film, said synthetic felt core layer, said extended ribbon pull loop and said bottom absorbent fabric layer ranges between 1 mm to 4 mm.

8. The insole topper pad according to claim 1, wherein said insole topper pad comprise of materials, that when assembled, will not float when submerged in water.

9. The insole topper pad according to claim 1, wherein said synthetic felt core layer provides stiffening structure to the insole topper pad.

10. The insole topper pad according to claim 1, wherein said insole topper pad is adapted to be moldable to both the bottom of a foot as well as, in conjunction, the adjacent interior portion of an article of footwear during use.

11. The insole topper pad according to claim 1, wherein said insole topper pad is configured to relinquish said contoured form, as molded during use, and return back to the relatively flat initial manufactured configuration upon submersion in water.

12. The insole topper pad according to claim 1, wherein said insole topper pad has a usable top surface and a usable bottom surface, therefore being reversible and allowing a single insole topper pad to be equally placed therein either a right hand article of footwear or a left hand article of footwear.

13. The insole topper pad according to claim 1, wherein said insole topper pad will clean a shoe's permanent insole due to the motion created from walking or exercising.

* * * * *